US005131481A

United States Patent [19]

Smith

[11] Patent Number: 5,131,481

[45] Date of Patent: Jul. 21, 1992

[54] INSERT HAVING A SURFACE OF CARBIDE PARTICLES

[75] Inventor: Emlyn N. Smith, Ligonier, Pa.

[73] Assignee: Kennametal Inc., Latrobe, Pa.

[21] Appl. No.: 630,147

[22] Filed: Dec. 19, 1990

[51] Int. Cl.[5] ..... E21B 10/46

[52] U.S. Cl. ..... 175/428; 407/119

[58] Field of Search ..... 175/410, 409, 374, 329, 175/411, 379; 51/295; 407/119

[56] References Cited

U.S. PATENT DOCUMENTS

| | | | |
|---|---|---|---|
| 2,628,821 | 2/1953 | Alexander et al. | 255/64 |
| 2,846,193 | 8/1958 | Chadderdon | 175/410 X |
| 2,879,973 | 3/1959 | Saxman | 255/64 |
| 3,379,503 | 4/1968 | McKenna | 23/208 |
| 3,442,342 | 5/1969 | McElya et al. | 175/374 |
| 3,495,668 | 2/1970 | Schumacher, Jr. | 175/341 |
| 3,519,092 | 7/1970 | Miller | 175/410 |
| 3,603,414 | 9/1971 | Stebley | 175/374 |
| 3,651,716 | 3/1972 | Stebley | 76/108 |
| 3,695,723 | 10/1972 | Kita et al. | 299/40 |
| 3,807,804 | 4/1974 | Kniff | 299/91 |
| 3,858,671 | 1/1975 | Kita et al. | 175/410 |
| 4,047,583 | 9/1977 | Dyer | 175/410 |
| 4,069,880 | 1/1978 | Johnstone et al. | 175/410 |
| 4,109,737 | 8/1978 | Bovenkerk | 175/329 |
| 4,211,508 | 7/1980 | Dill et al. | 407/120 |
| 4,570,726 | 2/1986 | Hall | 175/410 |
| 4,674,802 | 6/1987 | McKenna et al. | 299/79 |
| 4,694,918 | 9/1987 | Hall | 175/329 |
| 4,696,352 | 9/1987 | Buljan et al. | 175/410 X |
| 4,705,124 | 11/1987 | Abrahamson et al. | 175/410 |
| 4,711,144 | 12/1987 | Barr et al. | 76/108 |
| 4,716,976 | 1/1988 | Isakov | 175/410 |
| 4,834,963 | 5/1989 | Terry et al. | 423/440 |
| 4,940,099 | 7/1990 | Deane et al. | 175/374 |
| 4,984,940 | 1/1991 | Bryant et al. | 407/119 |

FOREIGN PATENT DOCUMENTS

| | | | |
|---|---|---|---|
| 2504589 | 10/1982 | France | 175/329 |
| 679193 | 12/1964 | Italy | 175/330 |
| 947440 | 1/1964 | United Kingdom | 175/410 |

OTHER PUBLICATIONS

"Kennametal Carbide Grades" (Published 1983).

"Carbide Components" (Published 1982).

"Kennametal Carbide Application Data-Kennametal Grade K3404" (1983).

"Kennametal Carbide Application Data—Kennametal Grade K6T" (1983).

"Kennametal Carbide Application Data—Kennametal Grade K3411" (1983).

"Kennametal Carbide Application Data—Kennametal Grade K3560" (1983).

*Primary Examiner*—Hoang C. Dang

*Attorney, Agent, or Firm*—John J. Prizzi; Larry R. Meenan

[57] ABSTRACT

An insert for insertion into a bore opening formed within a working face of a tool and a method of making the same. The insert includes a head having an integral body adapted for insertion into the bore. The insert has carbide particles adhered to the insert surface to resist removal of the insert from the bore opening.

12 Claims, 2 Drawing Sheets

INSERT HAVING A SURFACE OF CARBIDE PARTICLES

FIELD OF THE INVENTION

This invention relates to an insert having a surface of carbide particles and a method of making the same. More particularly, this invention relates to a button type insert having a textured surface and a method of making the same for insertion into a bore opening formed within a working face of a tool.

DESCRIPTION OF THE RELATED ART

Inserts known as button type inserts are widely used in tools for excavating, tunneling, and drilling earth formations. The tools exemplary of the type that may be used with the present invention include conical rotary bits, radial long wall cutter bits, percussion type mining bits, and roller or rolling cutter bodies for rotary mining bits, the latter including drilling and tunneling machines and the like. U.S. Pat. Nos. 4,716,976; 4,069,880; 2,879,973; 3,695,723; 3,442,342; 3,495,668; 2,628,821; 3,858,671, 3,519,092; 4,674,802; 3,807,804; 4,694,918; 4,711,144; and 4,047,583 are illustrative of just a few of the different types of tools that may be used with the present invention. The inserts may be mounted in the tool in appropriate locations for minimizing wear of the tool and in distributed relation within bore openings of a working face of the tool for impacting and cutting action.

Typically, insert bore openings having slightly smaller diameters than the insert diameters are drilled into the working face of the tool. The inserts are then forcibly inserted into the bore openings so that the inserts engage the walls of the bore openings in which they are mounted to provide an interference type fit.

The inserts are preferably made of a cemented hard metal carbide such as tungsten carbide-cobalt. Examples of some of the various grades of cemented tungsten carbide which may be used to form the insert are identified in the following Kennametal publications: Kennametal Carbide Grades, Carbide Components, Kennametal Carbide Application Data—Kennametal Grade K3404, Kennametal Carbide Application Data—Kennametal Grade K6T, Kennametal Carbide Application Data—Kennametal Grade K3411, and Kennametal Carbide Application Data—Kennametal Grade K3560.

The hard metal carbide inserts are manufactured by molding tungsten carbide and cobalt powders under die pressure to form oversize molded articles. The molded articles are then sintered to form solid sintered articles having the desired physical properties. Next, the inserts are ground to the desired size and form to provide inserts having a smooth finish for interference fitting with the aforementioned bore openings. The finished inserts are then pressed into the bore openings in the working face of the drill bit to seat the inserts firmly in the bore1 openings, with the outer ends or head portions of the inserts exposed at the working face from which they 1 project for impacting or cutting action. Inserts provided for minimizing the wear of a drill bit may lie flush with the face of the drill bit or project lesser distances therefrom. The inserts may also include a layer containing diamonds or have a polycrystalline diamond wafer bonded thereto.

It will be appreciated that in many instances the insert fits improperly within a bore opening because the diameter of the bore opening does not match the diameter of the insert within a prescribed tolerance. Thus, the insert works loose from and extends out of the bore opening resulting in the insert fracturing and breaking off within the bore opening during the impacting and cutting action. In many instances, the broken portion of the insert is impossible to remove from the bore opening, rendering the tool ineffective and thereby necessitating early replacement of the entire tool, causing increased downtime and expense.

In order to minimize the fracture of inserts within a tool, it has been found that by applying carbide particles such as tungsten carbide (WC) particles or tungsten titanium carbide ($WTiC_2$) particles and the like to the surface of the insert, the resistance to removal of the insert from a bore opening within a working face of a tool is improved. It is believed that a bond is formed between the carbide particles and the insert. More particularly, a bond is formed between tungsten carbide (WC) particles and the insert because the surface free energy of the tungsten carbide (WC) particles is less than that of the smaller particles comprising the insert such that the smaller particles dissolve and contribute to an inward growth of the tungsten carbide (WC) particles to provide a textured insert surface. This grain growth effect is also known as Ostwald Ripening. Moreover, it is believed that tungsten titanium carbide ($WTiC_2$) particles may also bond with the binder of the cemented carbide insert to provide a textured surface. The textured insert surface provides increased resistance to removal by increased interaction at the insert-bore interface.

Accordingly, it is an object of the present invention to provide a method for improving the resistance to removal of an insert from a bore opening.

Another object of the present invention is to provide an insert secured within a bore opening within a face of a tool exhibiting improved resistance to removal.

It is a further object of the present invention to provide an insert exhibiting improved resistance to removal from a bore opening within a tool that is simple and economical to manufacture.

SUMMARY OF THE INVENTION

Briefly, according to this invention, there is provided an insert for insertion into a bore opening. The insert includes a head having an integral body adapted for insertion into the bore opening. The insert has a surface of carbide particles, such as tungsten carbide or tungsten titanium carbide, adhered to the insert to resist removal of the insert from the bore opening.

In a preferred embodiment, the insert is a button type insert having a hemispherical head and a cylindrical body and has a surface of carbide particles adhered to only the cylindrical body.

BRIEF DESCRIPTION OF THE DRAWINGS

Further features and other objects and advantages of this invention will become clear from the following detailed description made with reference to the drawings in which.

DETAILED DESCRIPTION OF THE PREFERRED EMBODIMENT

Figure 1:
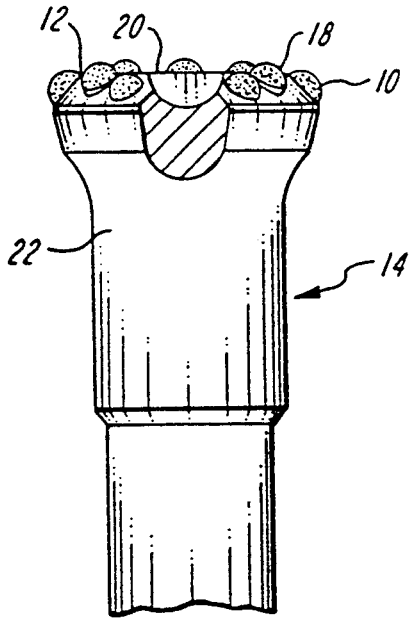
FIG. 1 is a side view of an embodiment of a percussion drill bit in accordance with the present invention.
Figure 2:
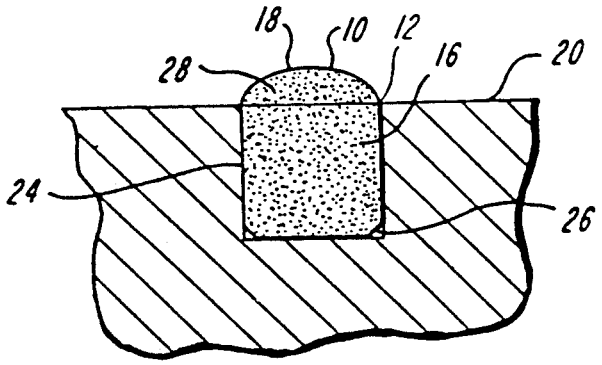
FIG. 2 is an enlarged sectional view of a button type insert and bore opening of the percussion drill bit of FIG. 1 having an outer layer of carbide adhered thereto.
Figure 5:
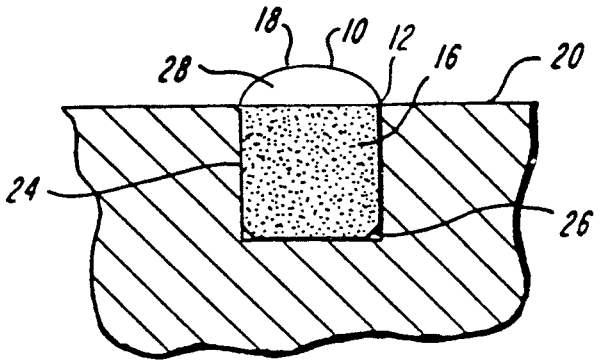
FIG. 5 is an enlarged sectional view of a button type insert and bore opening of the percussion drill bit of FIG. 1 having an outer layer of carbide adhered to only the body of the insert.

Referring to the drawing, wherein like reference characters represent like elements, FIGS. 1, 2 and 5 show a preferred cemented carbide button type insert 10 for insertion into a bore opening 12 within a working face 20 of a steel drill bit 14.

The button type insert 10 includes a cylindrical body 16 having a coterminous head 18. The head 18 is preferably of a hemispherical shape; however, the head may have any of a variety of shapes depending on the desired cutting structure of the insert. For example, the head 18 of the insert 10 may be cone-shaped, chisel-shaped, flat-shaped, tear drop-shaped, ballistic-shaped, or truncated cone-shaped or may have a polycrystalline diamond layer or wafer thereon.

The button type inserts 10 are inserted into a plurality of bore openings 12 formed within the working face 20 of the drill bit 14. The insert bore openings 12 are of a shape to substantially conform to the shape of the insert 10 received therein. As shown in FIGS. 2 and 5 the bore opening 12 is of a diameter slightly smaller than the insert diameter and is typically drilled into a working face 20 of a drill bit 14. The drill bit 14 as shown in FIG. 1 may be made of an air hardening steel or an alloy steel that heat treats to provide a Rockwell C hardness of at least 40.

The drill bit may be drilled either before or after the drill bit is heat treated to improve hardness. To correct for any heat distortion or drilling error, the drilled bore opening 12 may also be reamed. An exemplary bore opening 12, nominal diameter 0.5 inch, has a diameter about 0.0020 inch to 0.0025 inch smaller than the diameter of the cylindrical body 16 of a button type insert 10. The longitudinal axis of the bore openings 12 may be positioned about the working face 20 angular to and/or parallel to the axis of the body 22 of the drill bit 14 so that the impacting and cutting action of the inserts 10 will be effective at the periphery of the hole being cut by the bit.

The insert 10 may be press-fit with several thousand pounds of force into the bore opening 12 within the working face 20 of the drill bit 14 to expose the head 18 of the insert 10. The insert 10 may also be mounted into the bore opening 12 by heating the drill bit 14 to just below the tempering temperature and then pressing the insert into the bore opening to provide a shrink type fit. Any conventional pressing means such as a hammer, air-hammer, hydraulic press and positioner may be used. The cylindrical body 16 of the insert 10 engages the wall 24 of the matching bore opening 12 in which the insert is mounted to provide an interference type fit. As shown, the cylindrical body 16 of the insert 10 preferably has a chamfered outer edge 26 to assure proper seating of the insert on the bottom of the bore opening 12 to uniformly distribute cutting and impact forces to the insert and to the drill bit 14.

A surface 28 of carbide particles such as tungsten carbide (WC) or tungsten titanium carbide ($WTiC_2$) may be adhered randomly to the entire button type insert 10 (FIG. 2) or only to the periphery of the cylindrical body 16 of the button type insert (FIG. 5). The thin layer 28 of carbide particles is adhered to the insert 10 during or after the formation of the button type insert. For example, after resintering, the button type insert 10 may be ground to the desired form. The ground button type insert 10 may then be loose packed in the carbide particles preferably having a size of (−140+325 mesh) 0.0040 inch to 0.0017 inch in cross section. It will be appreciated that, if necessary, the carbide particles may be further milled and perform equally as well. The button type insert 10 is then heated in a furnace, preferably a hot isostatic type pressing furnace, to a sintering temperature such as 2550 degrees Fahrenheit in an inert atmosphere such as argon or helium and the like. The method of making conventional button type inserts by pressing and sintering techniques is well known by those skilled in the art.

Figure 3:
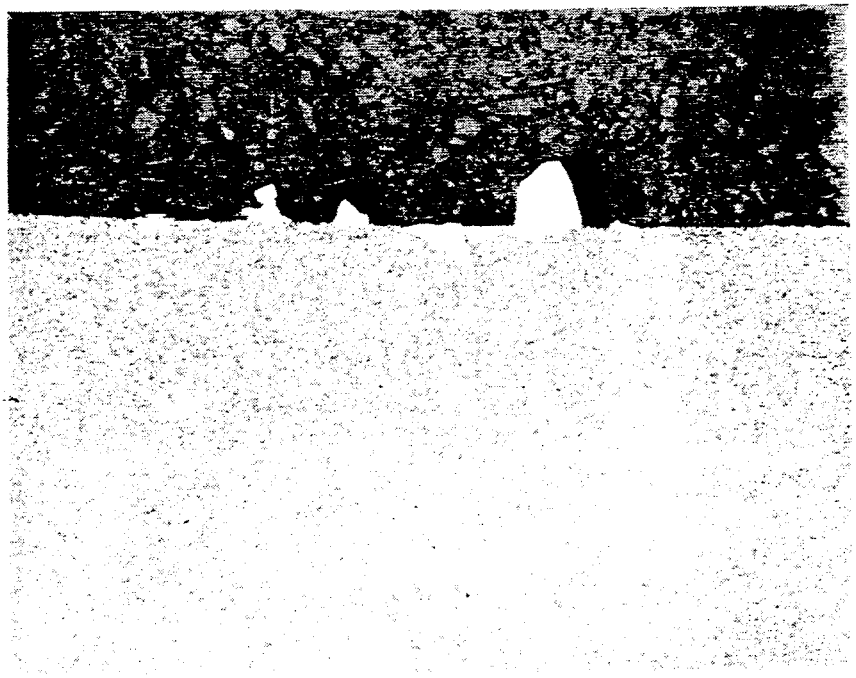
FIG. 3 is a photomicrograph of a cross-section of the interface between a steel surface and tungsten carbide particles bonded thereto (magnification 200X)
Figure 4:
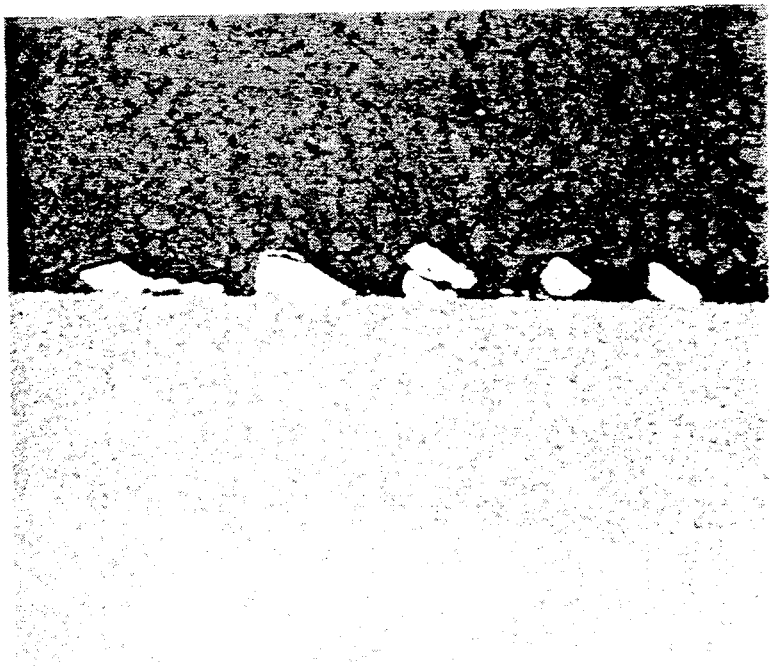
FIG. 4 is a photomicrograph of a cross-section of the interface between a steel surface and tungsten titanium carbide particles bonded thereto (magnification 200X).

As shown in FIG. 3 and FIG. 4, respectively, it is believed that an Ostwald Ripening effect occurs between the tungsten carbide (WC) particles and carbide particles of the insert and that cobalt at the surface of the ground button insert 10 autogenously bonds with the tungsten titanium carbide ($WTiC_2$) particles to provide a textured surface 28 to the cylindrical body 16 of the button type insert 10. The textured surface creates an interaction at the interface of the cylindrical body of the button type insert and the surface of the wall of the bore opening 12. It will be appreciated that most any type of particle material may be applied to the insert as long as the material does not sinter of its own accord to form excessive accretions and is of a hardness greater than steel. The particle material must also bond well with the insert. For example, a material that is capable of being "wet" by the cobalt binder of the insert to form an acceptable bond with the insert is considered to be a suitable particle material.

Although the present invention has been described in reference to an insert 10 mounted within a drill bit 14, the invention may also be used to improve the resistance to movement of any object relative to another object. For example, the present invention may be used to improve a joint between at least two objects pressed together with or without an interference type fit which cannot be welded or brazed because of dissimilar properties and/or geometries.

The present invention will be further clarified by a consideration of the following examples, which are intended to be purely exemplary of the use of the invention.

Example I

Button type inserts having a diameter of approximately 0.375 inch were prepared in accordance with conventional powder metallurgical techniques as described herein. Prior to the hot isostatic pressing phase of the powder metallurgical process, some of the button type inserts were positioned within a mass of tungsten carbide (WC) particles manufactured in accordance with U.S. Pat. Nos. 4,834,963 and 3,379,503, the subject matter of which is incorporated herein by reference. The button type inserts were then placed within a hot isostatic pressing type furnace at a temperature of 2550 degrees Fahrenheit for approximately one hour at a pressure of 15,000 psia in a helium atmosphere. As shown by FIG. 3, it is believed that a surface of tungsten carbide (WC) particles was autogenously bonded to the inserts.

For comparison purposes, the coated and uncoated button type inserts were then pressed into 0.375 inch diameter bore openings provided within two separate identical steel bars to provide a 0.002 to 0.0025 inch interference type fit. In order to approximate actual field conditions, several of the bore openings were coated with molybdenum disulfide ($MoS_2$). Molybdenum disulfide is a dry lubricant often used to assist in the insertion of a button type insert into a bore opening within a drill bit. The steel bars are made of AHT-28 having a typical composition of 0.30 wt.% C, 0.50 wt.% Mn, 0.020 wt.% P, 0.020 wt.% S, 0.25 wt.% Si, 1.40 wt.% Cr, 4.0 wt.% Ni, 0.20 wt.% Mo and the remainder Fe and impurities. AHT-28 is typical of the steel used in a working face of a drill bit.

The force required to press the inserts into and remove the inserts from the bore openings of the steel bars was then measured. As shown in Tables 1 and 2, which correspond to the first and second steel bars, respectively, the button type inserts having tungsten carbide (WC) particles adhered to the surface required a greater insertion force and removal force than button type inserts not having a surface of tungsten carbide (WC) particles.

TABLE 1

| SAMPLE BUTTON INSERT | INSERTION LOAD (LB.) | REMOVAL LOAD (LB.) |
|---|---|---|
| WC Surface | 20,000+ | 12,400 |
| WC Surface, $MoS_2$ | 18,100 | 10,850 |
| WC Surface, $MoS_2$ | 17,500 | 12,200 |
| No WC Surface | 11,800 | 9,400 |
| No WC Surface | 15,400 | 8,500 |
| No WC Surface | 7,400 | 6,750 |
| No WC Surface, $MoS_2$ | 8,450 | 7,250 |
| No WC Surface, $MoS_2$ | 6,600 | 5,700 |

TABLE 2

| SAMPLE BUTTON INSERT | INSERTION LOAD (LB.) | REMOVAL LOAD (LB.) |
|---|---|---|
| WC Surface | 20,000+ | 13,950 |
| WC Surface | 20,000+ | 12,500 |
| WC Surface, $MoS_2$ | 13,200 | 8,600 |

TABLE 2-continued

| SAMPLE BUTTON INSERT | INSERTION LOAD (LB.) | REMOVAL LOAD (LB.) |
|---|---|---|
| WC Surface, $MoS_2$ | 16,900 | 11,000 |
| No WC Surface | 6,850 | 6,350 |
| No WC Surface | 11,450 | 9,600 |
| No WC Surface, $MoS_2$ | 6,450 | 5,900 |
| No WC Surface, $MoS_2$ | 5,250 | 4,850 |

Having described presently preferred embodiments of the invention, it is to be understood that the invention may be otherwise embodied within the scope of the appended claims.

What is claimed is:

1. An insert for insertion into a bore opening formed within a tool, said insert comprising a head having an integral body adapted for insertion into the bore opening, said insert having carbide particles adhered to only said body of said insert at the surface thereof.

2. The insert as set forth in claim 1 wherein said carbide particles are tungsten carbide particles of a size approximately of 0.0040 to 0.0017 inch.

3. The insert as set forth in claim 1 wherein said carbide particles are tungsten titanium carbide particles of a size approximately of 0.0040 to 0.0017 inch.

4. The insert as set forth in claim 1 wherein said insert is a button type insert having a hemispherical head and a cylindrical body.

5. The insert as set forth in the claim 4 wherein said hemispherical head protrudes from said bore opening.

6. The insert as set forth in claim 4 wherein said insert is made of cemented tungsten carbide.

7. The insert as set forth in claim 4 wherein said insert is made of tungsten carbide-cobalt.

8. A tool comprising an insert for insertion into a bore opening formed within a working face of said tool, said insert including a head having an integral body adapted for insertion into said bore opening, said insert having carbide particles adhered to only said body of said inset at the surface thereof.

9. The insert as set forth in claim 8 wherein said carbide particles are tungsten carbide particles.

10. The insert as set forth in claim 8 wherein said carbide particles are of a size approximately of 0.0040 to 0.0017 inch.

11. The insert as set forth in claim 9 wherein said carbide particles are tungsten titanium carbide particles.

12. The insert as set forth in claim 8 wherein said insert is formed of a heard wear resistant material.

* * * * *